US006824745B2

(12) United States Patent
Roth

(10) Patent No.: US 6,824,745 B2
(45) Date of Patent: Nov. 30, 2004

(54) INTEGRATED CATALYTIC CONVERTER AND FLEXIBLE ENDCONE ASSEMBLY

(75) Inventor: Gregory Thomas Roth, Davison, MI (US)

(73) Assignee: Delphi Technologies, Inc., Troy, MI (US)

( * ) Notice: Subject to any disclaimer, the term of this patent is extended or adjusted under 35 U.S.C. 154(b) by 729 days.

(21) Appl. No.: 09/747,184

(22) Filed: Dec. 21, 2000

(65) Prior Publication Data

US 2002/0081244 A1 Jun. 27, 2002

(51) Int. Cl.[7] ..... B01D 53/34; F01N 3/28
(52) U.S. Cl. ..... 422/179; 422/177; 422/180
(58) Field of Search ..... 422/171, 177, 422/179, 180; 60/299

(56) References Cited

U.S. PATENT DOCUMENTS

| | | | | |
|---|---|---|---|---|
| 5,639,127 A | | 6/1997 | Davey | 285/49 |
| 5,878,567 A | | 3/1999 | Adamczyk, Jr. et al. | 60/274 |
| 5,967,565 A | | 10/1999 | Kim | 285/49 |
| 5,971,439 A | | 10/1999 | Cwik | 285/49 |
| 5,988,308 A | | 11/1999 | Qutub | 180/309 |
| 5,992,896 A | | 11/1999 | Davey et al. | 285/49 |
| 6,151,893 A | * | 11/2000 | Watanabe et al. | 60/322 |
| 6,159,430 A | | 12/2000 | Foster et al. | |
| 6,338,827 B1 | | 1/2002 | Nelson | |
| 6,354,903 B1 | | 3/2002 | Nelson | |
| 6,361,821 B1 | | 3/2002 | Anderson et al. | |
| 6,391,822 B1 | | 5/2002 | Dou et al. | |
| 6,438,839 B1 | | 8/2002 | Hardesty et al. | |
| 6,455,463 B1 | | 9/2002 | Labarge et al. | |
| 6,464,945 B1 | | 10/2002 | Hemingway | |
| 6,464,947 B2 | | 10/2002 | Balland | |
| 6,497,847 B2 | | 12/2002 | Foster et al. | |
| 6,532,659 B1 | | 3/2003 | DeSousa et al. | |
| 6,591,497 B2 | | 7/2003 | Foster et al. | |
| 6,605,259 B1 | | 8/2003 | Henry | |
| 6,623,704 B1 | | 9/2003 | Roth | |
| 6,624,113 B2 | | 9/2003 | Labarge et al. | |
| 6,643,928 B2 | | 11/2003 | Hardesty et al. | |

FOREIGN PATENT DOCUMENTS

| | | | |
|---|---|---|---|
| JP | 11-22455 | * | 1/1999 |

* cited by examiner

*Primary Examiner*—Hien Tran
(74) *Attorney, Agent, or Firm*—Paul L. Marshall

(57) ABSTRACT

An catalytic converter is integrated with a flexible endcone to form an assembly. The assembly comprises a catalytic converter with a flexible endcone integrated connected to one end of the catalytic converter, which is optionally attached to a mounting flange or exhaust pipe. The endcone comprises a flexible bellow containing a plurality of undulating ribs. The flexible bellow is secured to an end of the catalytic converter at one or more interface points along the periphery of the flexible endcone assembly.

19 Claims, 5 Drawing Sheets

INTEGRATED CATALYTIC CONVERTER AND FLEXIBLE ENDCONE ASSEMBLY

TECHNICAL FIELD

The disclosure relates to catalytic converters and, more particularly, to an apparatus and method for manufacturing an integrated catalytic converter and flexible endcone assembly.

BACKGROUND

Catalytic converters are devices incorporated into a mobile vehicle's exhaust system that reduce the amount of pollutants found in exhaust gases to environmentally harmless levels. The catalytic converter is placed under strenuous operating conditions due to experiencing constant vibrational and oscillating motions, axial and torsional loads, exposure to environmentally unfriendly components exhaust gas, temperature gradients of approximately 1,000° C. or more, corrosion, and other typical conditions.

Conventional catalytic converters can experience strain-induced fatigue due to constant vibrational and oscillating motions, axial and torsional loads, and thermal stress during operation. Some conventional exhaust systems for mobile vehicles employ existing flex coupling assemblies that decouple the exhaust system from the engine and/or from other exhaust system components. These assemblies are designed and manufactured separately from the catalytic converter and other exhaust system components.

For example, the flexible coupler apparatus described in U.S. Pat. No. 5,992,896, to Davey et al., and assigned to Senior Engineering Investments AG, employs a pipe inner member disposed within a pair of pipe adapters affixed to adjacent pipe ends, and a pair of spacer members enclosed, respectively, between the opposing ends of the adapter members and pipe inner members. The design further incorporates a biasing means for imparting an axial bias or preload to the coupler apparatus, for providing progressive resistance to compression of the coupler apparatus. A flexible sealing member mechanically connects the adapter members, and, in turn, the pipe ends.

A drawback to the design of Davey et al. is the numerous components required to effectively preclude transmission of vibrations between two pipes in an exhaust system. Davey et al. desire to provide an enhanced, robust coupling apparatus; however, the adapters, additional piece of pipe, sealing members and additional biasing member add weight to the entire exhaust system while also taking up additional space. Conventional vehicle systems maintain stringent space requirements, and preferably seek to incorporate fewer components of lighter weights. For example, exhaust manifold assemblies are now designed to attach between pipes leading from the engine combustion chamber to the catalytic converter, thereby eliminating the need, in some instances, for a single exhaust pipe, or plurality of pipes as contemplated in Davey et al.

The exhaust system also typically experiences several adverse effects stemming from these conventional flexible coupling components. Adverse effects, such as exhaust gas stream flow restrictions, increased weight of the exhaust system, and additional costs are typically attributable to existing flex coupling components.

Accordingly, there exists a need for an apparatus and method for manufacturing a catalytic converter having an integrated flexible coupling device.

SUMMARY

The drawbacks and disadvantages of the prior art are overcome by the exemplary embodiments of the integrated catalytic converter/flexible endcone assembly, a method for making the same, as well as a method for treating exhaust gas described herein. The integrated catalytic converter/flexible endcone assembly, comprises a flexible endcone. The flexible endcone has a flexible bellow with a plurality of undulating ribs concentrically radiating outward from an inlet to a periphery. The catalytic converter, which comprises a mat material concentrically disposed around a catalyst substrate and between the catalyst substrate and a shell, is in physical contact and fluid communication with endcone. Essentially, the catalytic converter is sealingly secured to the periphery of the flexible bellows.

The method for manufacturing the integrated catalytic converter/flexible endcone assembly, comprises disposing a catalyst substrate concentrically within a shell. A mat support material is disposed concentrically in between the catalyst substrate and shell. The flexible endcone assembly is secured to the catalytic converter at the periphery of the flexible bellows such that the flexible endcone assembly and the catalytic converter are in physical contact and fluid communication with one another.

The method for treating exhaust gas, comprises passing exhaust gas through the integrated catalytic converter/flexible endcone assembly and catalytically treating one or more constituents in the exhaust gas.

BRIEF DESCRIPTION OF THE DRAWINGS

Referring now to the figures, which are meant to be exemplary, not limiting, and wherein like elements are numbered alike in the several figures.

DESCRIPTION OF THE PREFERRED EMBODIMENT

Figure 1:
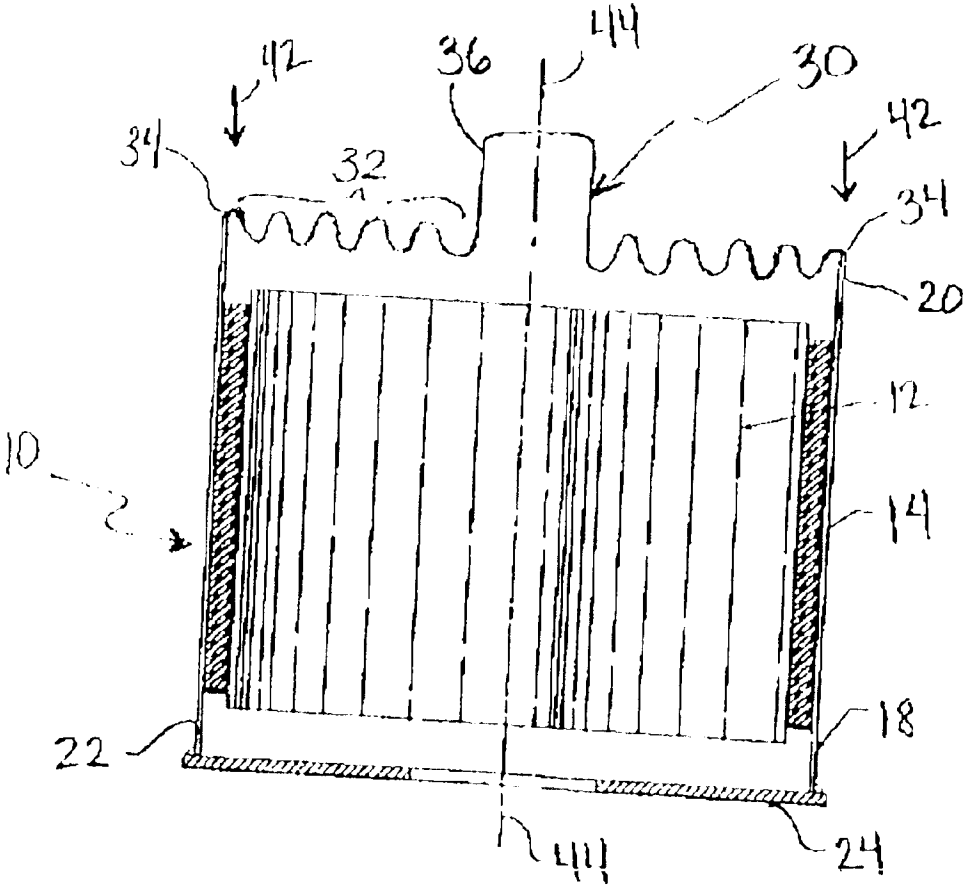
FIG. 1 is a partial cross-sectional view of an exemplary embodiment of a catalytic converter integrated with an exemplary flexible endcone assembly.

An integrated catalytic converter and exemplary flexible endcone assembly comprises a flexible endcone assembly integrated into the inlet and/or outlet end of the catalytic converter, and attached to a mounting flange, exhaust pipe, connecting pipe, exhaust manifold cover, or other exhaust system component to facilitate the fluid communication with an exhaust system. The flexible endcone assembly comprises an endcone having a flexible bellow secured to the catalytic converter shell at one or more interface points along the periphery of the bellow. An inlet projects outwardly, preferably from the center, of the flexible bellow, and is secured to a mounting flange, a connecting pipe, an exhaust manifold assembly, or other exhaust system component. These exhaust system components can be further secured to yet another exhaust system component to facilitate the fluid communication with the exhaust system.

A catalytic converter for a mobile vehicle can catalytically treat exhaust gas streams using a catalyst disposed on one or more catalyst substrates. The catalyst substrates can comprise any material designed for use in a spark ignition or diesel engine environment, and have the following characteristics: (1) capable of operating at high temperatures (e.g., up to about 1,000° C.), (2) capable of withstanding exposure to hydrocarbons, nitrogen oxides, carbon monoxide, carbon dioxide, and/or sulfur, and other exhaust gas constituents; and (3) having sufficient surface area and structural integrity to support the desired catalyst. Some possible materials include cordierite, silicon carbide, metallic foils, alumina sponges, porous glasses, and the like, and mixtures comprising at least one of the foregoing. Some ceramic materials include "HONEY CERAM", commercially available from NGK-Locke, Inc, Southfield, Mich., and "CELCOR", commercially available from Corning, Inc., Corning, N.Y.

Although the catalyst substrates can have any size or geometry, the size and geometry are preferably chosen to optimize the surface area in the given converter design parameters. Typically, the catalyst substrate has a honeycomb geometry, with the combs being any multi-sided or rounded shape, with substantially square, hexagonal, octagonal or similar geometries preferred due to the ease of manufacturing and increased surface area.

Disposed on and/or throughout the catalyst substrates is a catalyst for converting exhaust gases to acceptable emissions levels as is known in the art. The catalyst may comprise one or more catalyst materials that are wash coated, imbibed, impregnated, physisorbed, chemisorbed, precipitated, or otherwise applied to the catalyst substrate. Possible catalyst materials include metals, such as platinum, palladium, rhodium, iridium, osmium, ruthenium, tantalum, zirconium, yttrium, cerium, nickel, copper, and the like, as well as alloys, oxides, and mixtures comprising at least one of the foregoing metals, and other conventional catalysts.

Located in between the catalyst substrates and a catalytic converter shell is a mat support material that insulates the shell from both the high exhaust gas temperatures and the exothermic catalytic reaction occurring within the catalyst substrate. The mat support material, which enhances the structural integrity of the catalyst substrate by applying compressive radial forces about it, reducing its axial movement, and retaining it in place, is concentrically disposed around the catalyst substrate to form a mat support material/catalyst substrate subassembly. The mat support material can either be an intumescent material, e.g., one which contains ceramic materials, and other conventional materials such as an organic binder and the like, or combinations comprising at least one of the foregoing, and a vermiculite component that expands with heating to maintain firm uniform compression when the shell expands outward from the catalyst substrate, or a non-intumescent material, which does not contain vermiculite, as well as materials which include a combination of both. Typical non-intumescent materials include materials sold under the trademarks "NEXTEL" and "SAFFIL" by the "3M" Company, Minneapolis, Minn., or those sold under the trademark, "FIBERFRAX" and "CC-MAX" by the Unifrax Co., Niagara Falls, N.Y., and the like. Intumescent materials include materials sold under the trademark "INTERAM" by the "3M" Company, Minneapolis, Minn., as well as those intumescents which are also sold under the aforementioned "FIBERFRAX" trademark, as well as combinations thereof and others.

The mat support material/catalyst substrate subassembly can be concentrically disposed within a shell. The shell includes at least one opening or the passage of an exhaust gas stream through the catalytic converter. One end of the shell is preferably fitted with the exemplary endcone assembly, and the opposing opening can be formed integrally with the shell using a means for forming, such as, e.g., a spin forming method, or a conventional end cone, end plate, exhaust manifold cover, and the like, can be concentrically fitted about the opposing opening and secured to the shell to provide a gas tight seal. The choice of material for the shell depends upon the type of exhaust gas, the maximum temperature reached by the catalyst substrate, the maximum temperature of the exhaust gas stream, and the like. Suitable materials for the shell can comprise any material that is capable of resisting under-car salt, temperature and corrosion. Typically, ferrous materials are employed such as ferritic stainless steels. Ferritic stainless steels can include stainless steels such as, e.g., the 400—Series such as SS-409, SS-439, and SS-441, with grade SS-409 generally preferred.

Referring generally to FIG. 1, a catalytic converter 10 can preferably be attached to an exemplary flexible endcone assembly 30. The flexible endcone assembly 30 comprises a flexible bellow 32. The flexible bellow 32 can be attached to the catalytic converter 10 via one or more interface points 34 located at the periphery of the endcone 30 (See FIG. 1). An inlet 36 outwardly projects from the center of the flexible bellow 32, and attaches using, e.g., a mechanical, welding, or sealing operation, and the like, to a mounting flange 38 (See FIG. 6) or a connecting pipe (not shown), which can be further attached to an exhaust system component such as an exhaust manifold assembly or an exhaust pipe (not shown).

Figure 6:
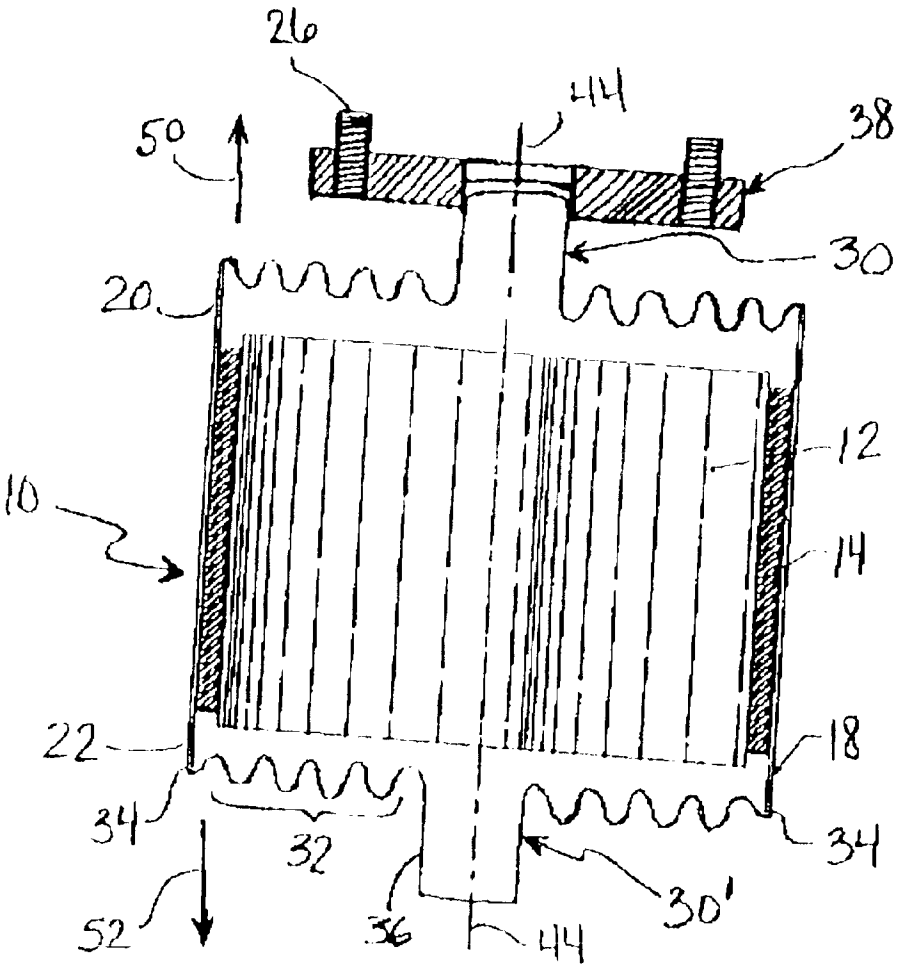
FIG. 6 is a partial cross-sectional view of another exemplary embodiment of an integrated catalytic converter mounted to an exemplary flexible endcone assembly of FIG. 1 using a mounting flange.

Referring generally now to FIGS. 2–5, the flexible endcone 30 can preferably include a flexible bellows 32, whereby the bellow comprises a cross-sectional geometry, such as rounded or multisided, e.g., oval, circular, triangular, square, rectangular, pentagonal, hexagonal, heptagonal, octagonal, and the like, with a circular geometry preferred (See FIG. 6). The bellow 32 can include one or more first ribs 40, and second ribs 40', respectively, concentrically radiating outward from the outwardly projecting inlet 36 (See FIGS. 3–5). The inlet 36 can project from the bellow 32, in a direction opposite the catalytic converter assembly 10. The ribs 40, 40' can preferably form the undulating shape of the bellow 32, which facilitates the flexible movement of the flexible endcone assembly 30. The inlet 36 can have a geometry, such as circular, oval, multi-sided, and the like, that compliments the geometry of the catalytic converter, conduit, pipe, a mounting flange, or other exhaust system component to which the endcone is connected to, accordingly.

Figure 2:
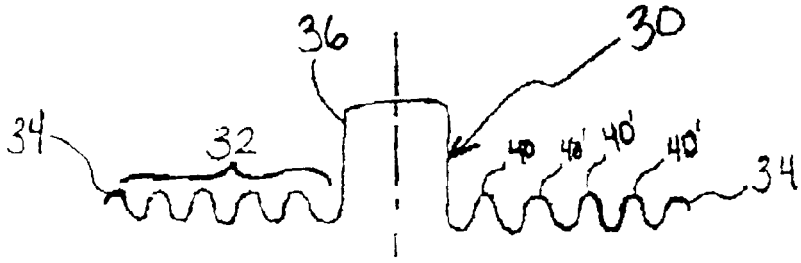
FIG. 2 is a cross-sectional view of the exemplary flexible endcone assembly of FIG. 1.
Figure 3:
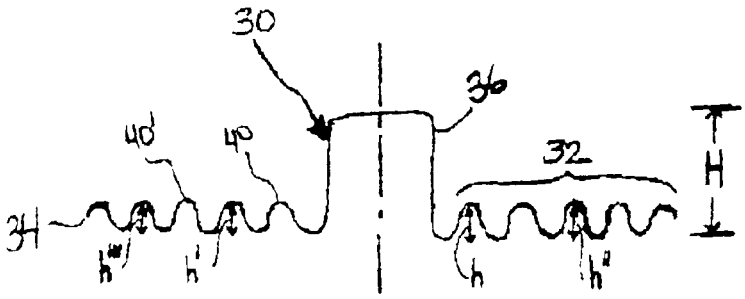
FIG. 3 is another cross-sectional view of the exemplary flexible endcone assembly of FIG. 1.

In FIGS. 2–3, the bellow 32 is illustrated as having four ribs 40, 40'. However, the number of ribs 40, 40' can be increased or decreased according to the requirements of specific application of the flexible endcone assembly 30. For example, the flexibility of the bellow 32 can be increased or decreased by increasing or decreasing both the number of ribs 40, 40' and their heights h, h', h", h'" for each individual rib 40, 40', respectively, of the bellow 32 (See FIG. 3). The ribs 40, 40' can preferably have heights h, h', h", h'" which are equal, increasing from h to h'", or decreasing from h to h'". Typically heights of about 1.00 millimeters to about 6.00 millimeters can be employed. The heights, however, are ultimately dependent upon the particular application, and, therefore, may vary substantially with each particular application.

Figure 4:
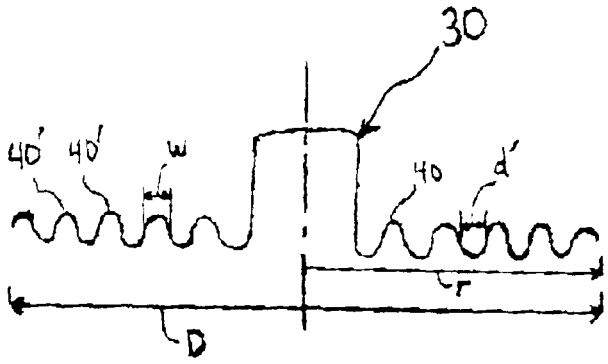
FIG. 4 is yet another cross-sectional view of the exemplary flexible endcone assembly of FIG. 1.
Figure 5:
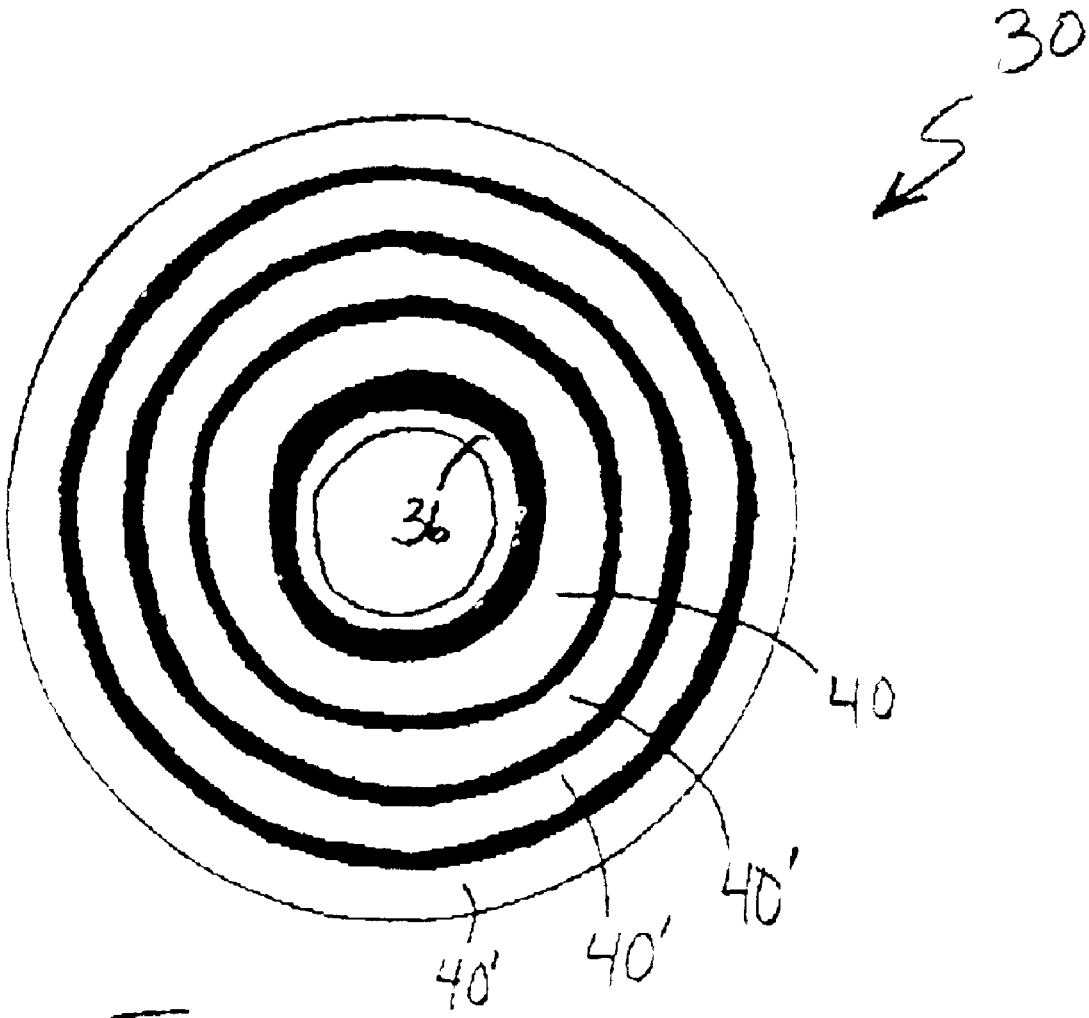
FIG. 5 is a top view of the exemplary flexible endcone assembly illustrated in FIG. 1.

Referring now to FIG. 4, each rib 40, 40' can also be increased or decreased in width "w" while the radius "r" and/or diameter "D" of the bellow 32 can remain constant, increase, or decrease incrementally, or in proportion to the width "w". Furthermore, the distance "d" between each rib 40, 40' can be adjusted as the number of ribs 40 increases, decreases or remains constant. In addition, in the exemplary embodiment of the flexible endcone design shown in FIGS. 3 and 4, the flexible bellow 32 can preferably have a height "H" of about 5.00 millimeters to approximately about 40 millimeters, however; the height "H" is ultimately dependent upon the particular application, and, therefore, may vary substantially with each particular application.

The choice of material for the flexible bellow 32, and entire flexible endcone assembly 30, depends upon the type of exhaust gas, the maximum temperature of the exhaust gas stream, mounting location, system loads, vibrational loads, and the like. Suitable materials for the flexible bellow 32, and flexible endcone assembly 30, can comprise any material that is capable of resisting under-car salt, temperature, corrosion, and high stress levels. Typically, a ferrous material is employed such as high strength ferritic stainless steels. Ferrous stainless steels can include stainless steels such as, e.g., the 400-Series such as SS-409, SS-439, and SS-441, as well as the 300 series such as SS-304 and SS-316, and "INCONEL", commercially available from Gibbs Wire & Steel Co., Inc. Charlotte, N.C., and the like, with "INCONEL" generally preferred.

The flexible bellow 32 of the flexible endcone assembly 30 can preferably be formed and manufactured using conventional sheet metal forming processes such as using a stamping die having preformed ribs to create ribs 40, 40', and inlet 36 (See FIGS. 2–4). The flexible bellow 32 can preferably have a cross-sectional geometry that can flex upon application of axial and torsional vibrational loads.

As shown in FIG. 1, at least one flexible endcone assembly 30 can be joined to either one or both ends 20, 22 of the catalytic converter 10 by exerting a force in the general direction of arrow 42 to form a gas-tight seal between the interface points 34 and either one or both ends 20, 22. The interface points 34 can define a joint configuration such as a lap joint, butt joint, tee joint, and the like, as well as combinations comprising at least one of the foregoing joints, which can be sealed mechanically or by a sealing agent such as a weld, crimp, lockseam, and the like, or by a combination of techniques comprising at least one of the foregoing sealing agents. More specifically, and preferably, an edge weld can be disposed concentrically about the circumference and/or at the interface points 34 where the flexible endcone assembly 30 and ends 20, 22 meet.

When a torque generated by the engine is adsorbed by the flexible engine mounts, the engine can "roll" several degrees about is roll center, which is commonly known to those skilled in the art as "engine roll". The flexible endcone assembly 30 can adsorb the force exerted by the engine roll by rotating itself and the catalytic converter several degrees in either a clockwise, counter-clockwise, or in both directions about its axis 44. Optionally, the rotational freedom of movement can be limited by placing a device for limiting the rotational movement within the inlet of the flexible endcone assembly that engages both the stationary mounting flange and inlet. However, without employing any limiting device, the amount of rotational freedom of movement in either a clockwise, counter-clockwise, or in both directions, can preferably be up to about 10 degrees, up to about 5 degrees preferred, and about 1 degrees or less more preferred. As the rotatably flexible endcone assembly 30' rotates and deflects clockwise and/or counter clockwise, a second flexible endcone assembly 30 mounted to the opposing end of the catalytic converter can flex about its axis to adsorb, and deflect any residual rotational, vibrational or torsional load acting upon the catalytic converter.

Essentially, the flexible endcone assembly's freedom of movement about its axis 44 enables it to accommodate exhaust system movement caused by engine roll, engine vibration, exhaust system vibration, and exhaust system thermal expansion. Furthermore, the flexible endcone assembly 30, can also isolate the catalytic converter from engine vibration, which, in turn, reduces the amount of audible noise produced by the catalytic converter.

An integrated catalytic converter/flexible endcone assembly can preferably be manufactured for a mobile vehicle's exhaust system by forming a catalyst substrate 12 comprising a catalyst, e.g., by extrusion or other conventional process, and the like, followed by applying the catalyst, e.g., by deposition or other introduction of the catalyst, and the like. The mat support material 14 can be concentrically disposed around the catalyst substrate 12 with the combination then disposed concentrically within a shell 118 having an end 20, an end 22 and an opening therebetween to allow for the passage of exhaust gas. Meanwhile, a flexible endcone assembly 30 comprising a flexible bellow 32 with an outwardly projecting inlet 36 and a plurality of undulating ribs 40, 40' concentrically radiating outward from the inlet 36 to the periphery of the endcone 30 is formed. The flexible bellow 32 is secured at one or more interface points 34 to the end 20 of the catalytic converter assembly such that the inlet 36 and the end 20 of the catalytic converter 10 are in fluid communication. The end 22 of the shell 18, opposite the flexible endcone 30, has an end plate 24, a conventional endcone (not shown), or other type of cover disposed about the end 22.

The inlet 36 of the flexible endcone assembly 30 can be attached using a mechanical attachment, welding or sealing operation, and/or the like, to a connecting pipe (not shown), exhaust pipe, exhaust manifold assembly, or other exhaust system component such that the exhaust system component is in fluid communication with the flexible endcone assembly 30. A plurality of securement members 26, such as a stud, screw, clamp, weld, bracket, and the like, can preferably sealingly secure the inlet 36 of the flexible endcone assembly 30 to the mounting flange 38. The mounting flange 38 can be further attached to an exhaust manifold assembly, or an exhaust pipe, or an exhaust system component for a mobile vehicle, such that the exhaust manifold assembly, or exhaust pipe or exhaust system component is in fluid communication with an exhaust system. The flexible endcone assembly 30, is in fluid communication with both the exhaust system of the mobile vehicle and the catalytic converter. As vibrational and/or torsional forces, and/or engine roll acts upon the exhaust system, the flexible endcone assembly 30, can adsorb the forces by expanding/contracting in a linear movement along their respective axis 44, and rotating clockwise/counter-clockwise about their respective axis 44.

In an embodiment shown in FIG. 6, during operation of a vehicle, the flexible endcone 30 can also be fixedly attached to a mounting flange 38 at the inlet 36. Exhaust system gases pass through the coupling assembly, into the catalytic converter where it is treated, and exits typically through endcone 30, and into the exhaust system. As forces are imparted upon the flexible endcone 30, the endcone 30 can move linearly in the direction of either arrows 50 or 52. The flexible endcone 30 provides linear freedom of movement along the axis 44 of the assembly, and a limited freedom of movement perpendicular to its axis 44. The amount of linear freedom of movement can be up to about 25.00 mm when expanding and/or contracting, with up to about 7.00 mm preferred, and about 1.50 mm to about 3.00 mm especially preferred.

Figure 7:
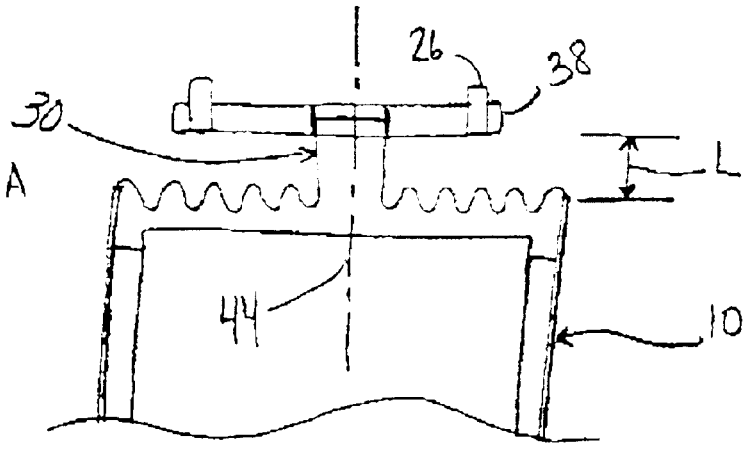
FIG. 7 is a partial cross-sectional view of an exemplary embodiment of an integrated catalytic converter/flexible endcone assembly at a resting position.
Figure 8:
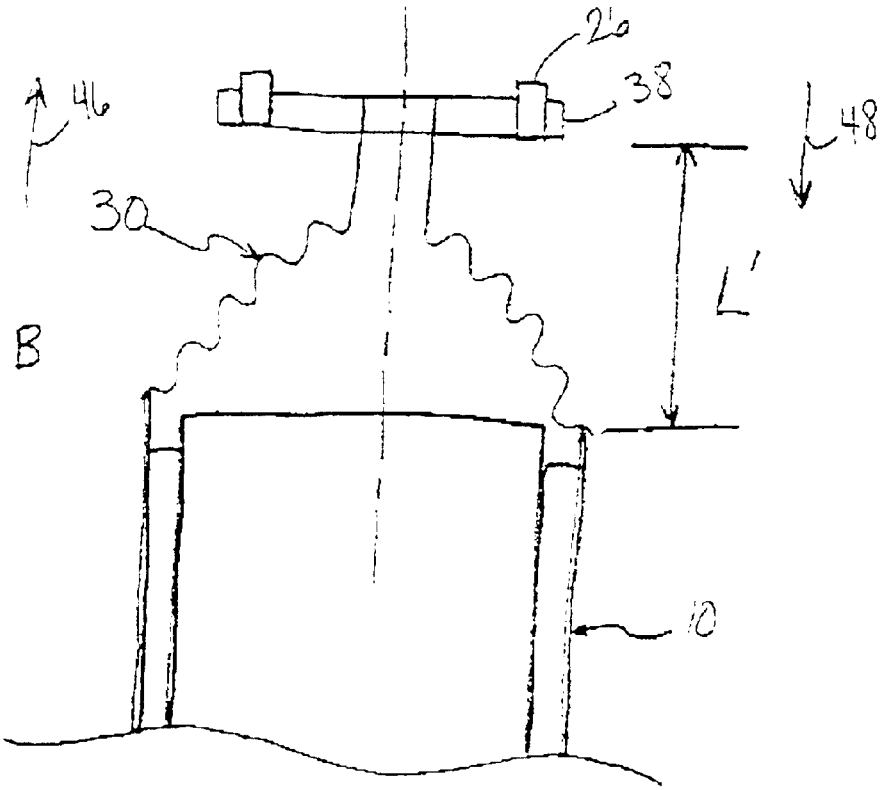
FIG. 8 is a partial cross-sectional view of the integrated catalytic converter/flexible endcone assembly while in motion during operation.

Under cold start conditions, that is, before the catalytic converter begins operating, the flexible endcone assembly initially maintains a resting position, such as resting position A in FIG. 7, and has a resting length of L. When the catalytic converter is operating, and the engine begins imparting vibrational and torsional loads upon the catalytic converter, the flexible endcone assembly 30 begins to flex and move in a direction indicated by an arrow 46 to a flexed position B having a flexed length L', which is any length other than resting length L (See FIG. 8). Likewise, as the vibrational and torsional forces continue to act upon the catalytic converter, the flexible endcone assembly 30 flexes and moves in a direction opposite arrow 46, and in the direction indicated by arrow 48, to another flexed position B having another flexed length L'.

The integrated catalytic converter/flexible endcone assembly provides several advantages over conventional catalytic converters mounted to existing coupling assemblies. First, the flexible endcone assembly can integrate easily with the existing catalytic converter designs utilized today. The flexible endcone assembly can be fitted to conventional catalytic converters and, likewise, to existing exhaust pipe designs, or a mounting flange, when necessary, to meet the requirements and specifications of the intended application. The flexible endcone assembly occupies the minimum amount of space along the axis of the catalytic converter assembly while providing an effective substitute for a flexible coupling apparatus/endcone assembly combination. Accordingly, the catalytic converter/flexible endcone assembly can be utilized with existing catalytic converters and their mounting requirements.

Second, the flexible endcone assembly is designed to overcome several disadvantages inherent in existing coupling assemblies. Conventional flex coupling assemblies adversely impact existing catalytic converter designs by restricting the exhaust gas stream flow entering the converter, increasing the mass of the exhaust system, increasing the cost of the exhaust system, and decreasing the packaging flexibility of the system.

While preferred embodiments have been shown and described, various modifications and substitutions may be made thereto without departing from the spirit and scope of the invention. Accordingly, it is to be understood that the present invention has been described by way of illustration and not limitation.

What is claimed is:

1. An integrated catalytic converter/flexible endcone assembly, comprising:

a flexible endcone assembly comprising a flexible bellow having a plurality of undulating ribs concentrically radiating outward from an inlet to a periphery; and a catalytic converter in physical contact and fluid communication with said periphery, wherein said catalytic converter comprises a shell concentrically disposed about a mat material which is concentrically disposed about a catalyst substrate comprising a catalyst.

2. The integrated catalytic converter/flexible endcone assembly recited in claim 1, wherein said periphery further comprises a plurality of interface points comprising a joint configuration selected from the group consisting of a lap joint, butt joint, tee joint, and combinations comprising at least one of the foregoing joints.

3. The integrated catalytic converter/flexible endcone assembly recited in claim 2, wherein said catalytic converter is, sealingly secured to said periphery at said plurality of interface points.

4. The integrated catalytic converter/flexible endcone assembly recited in claim 1, wherein said inlet further comprises a cylindrical portion extending from said plurality of ribs in a direction opposite said catalytic converter.

5. The integrated catalytic converter/flexible endcone assembly recited in claim 1, further comprising a mounting flange with at least one securement member selected from the group consisting of a stud, screw, clamp, weld, bracket, and combinations comprising at least one of the foregoing securement members, wherein said mounting flange is rotatably attached to said inlet.

6. The integrated catalytic converter/flexible endcone assembly recited in claim 1, wherein said endcone assembly is capable of moving rotationally about an axis concentrically disposed through said inlet.

7. The integrated catalytic converter/flexible endcone assembly recited in claim 1, wherein said endcone assembly is capable of moving linearly along an axis concentrically disposed through said inlet.

8. The integrated catalytic converter/flexible coupling assembly recited in claim 1, wherein said catalytic converter further comprises a member selected from the group consisting of an endplate, an endcone, and a second flexible endcone, concentrically disposed about an opposite end of said shell, and connecting said catalytic converter to an exhaust system component.

9. A method for manufacturing an integrated catalytic converter/flexible endcone assembly, comprising:

forming a catalyst substrate comprising a catalyst;

disposing said catalyst substrate concentrically within a shell having an opening;

disposing a mat support material concentrically in between said catalyst substrate and said shell; and securing said catalytic converter to a periphery of a flexible endcone assembly such that said flexible endcone assembly and said catalytic converter are in physical contact and fluid communication, wherein said flexible endcone assembly comprises a flexible bellow with a plurality of undulating ribs concentrically radiating outward from an inlet to said periphery.

10. The method recited in claim 9, further comprising securing said catalytic converter to said periphery at a plurality of interface points.

11. The method recited in claim 10, wherein the catalytic converter is secured to the periphery of the flexible endcone assembly using a bond selected from the group consisting of a weld, crimp, lock seam, sealant, and combinations comprising at least one of the foregoing bonds.

12. A method for treating exhaust gas, comprising:

introducing exhaust gas to an integrated catalytic converter/flexible endcone assembly comprising a flexible endcone assembly a flexible bellow comprising a plurality of undulating ribs concentrically radiating outward from an inlet to a periphery, and a catalytic converter in physical contact with said periphery and in fluid communication with said flexible endcone assembly, wherein the catalytic converter comprises a shell concentrically disposed about a mat support material which is concentrically disposed about a catalyst substrate comprising a catalyst;

passing the exhaust gas through said flexible endcone assembly and through said catalytic converter; and catalytically treating one or more constituents in the exhaust gas.

13. The method recited in claim 12, further comprising moving said flexible endcone assembly in a first linear direction to adsorb vibration.

14. The method recited in claim 13, further comprising increasing a resting length of the flexible endcone assembly, wherein a distance between said catalytic converter and an exhaust system similarly increases.

15. The method recited in claim 14, further comprising moving said flexible endcone assembly in a second linear direction wherein the resting length of the flexible endcone assembly decreases, and the distance between the catalytic converter and an exhaust system similarly decreases.

16. The method recited in claim 12, further comprising rotating said flexible endcone assembly.

17. The method recited in claim 16, wherein said rotating further comprises rotating said flexible endcone assembly in a clockwise direction, a counter-clockwise direction, or a combination thereof.

18. The method recited in claim 17, wherein said rotating further comprises rotating said flexible endcone assembly clockwise up to about 10 degrees.

19. The method recited in claim 18, wherein said rotating further comprises rotating said flexible endcone assembly counter-clockwise up to about 10 degrees.

* * * * *